US007281488B1

(12) United States Patent
Sanders

(10) Patent No.: US 7,281,488 B1
(45) Date of Patent: Oct. 16, 2007

(54) SEAT FOR SHALLOW DRAFT FLOATING WATERCRAFT

(76) Inventor: Roy F. Sanders, 9512 Hopeland, Austin, TX (US) 78749

( * ) Notice: Subject to any disclaimer, the term of this patent is extended or adjusted under 35 U.S.C. 154(b) by 0 days.

(21) Appl. No.: 11/517,679

(22) Filed: Sep. 8, 2006

Related U.S. Application Data

(63) Continuation-in-part of application No. 11/139,939, filed on May 27, 2005, now Pat. No. 7,111,569.

(51) Int. Cl.
*B63B 17/00* (2006.01)

(52) U.S. Cl. ..... 114/363; 114/364

(58) Field of Classification Search ..... 114/343, 114/363, 364
See application file for complete search history.

(56) References Cited

U.S. PATENT DOCUMENTS 4,146,279 A * 3/1979 Stahel ..... 114/363
4,773,709 A * 9/1988 Slinkard ..... 114/363
5,050,526 A * 9/1991 Nelson et al. ..... 114/364
5,662,061 A * 9/1997 Salathe ..... 114/363
7,111,569 B1 * 9/2006 Sanders ..... 114/61.2

* cited by examiner

*Primary Examiner*—Lars A. Olson
(74) *Attorney, Agent, or Firm*—Buskop Law Group, PC; Wendy Buskop

(57) ABSTRACT

A molded seat for individually propelled watercraft having a deck with sloped sides extending there from and a plurality of opposing grooves of a defined shape formed in the deck and sloping sides. The seat has at least 4 legs to integrate into corresponding grooves formed into the deck, where the base has a bottom integral with the at least 4 legs and 4 integral side walls rising from the bottom. The two side walls opposing each other further comprise small extensions to extend over the sloping sides of a watercraft for a secure engagement with the watercraft and at least one side wall comprises at least one rod holder.

8 Claims, 13 Drawing Sheets

SEAT FOR SHALLOW DRAFT FLOATING WATERCRAFT

CROSS REFERENCE TO RELATED APPLICATIONS

The present application is a CIP to U.S. patent application Ser. No. 11/139,939 filed on May 27, 2005 now U.S. Pat. No. 7,111,569.

FIELD

The present embodiments relate generally to seat for a lightweight floating watercraft wherein the watercraft can be used for fishing and repair of bridges, installation of endangered water plants and other uses. The lightweight floating watercraft enables a person to sit or stand on the watercraft without flipping over during poling, rowing, fishing and other activities.

BACKGROUND

Fishing boats traditionally are standard monohull designs, such as those used for bass boats, Boston Whalers™ or standard rowboats. With monohull designs, fishermen could not stand up in a boat without flipping over the boat or simply falling out of the boat.

A need exists for a safer boat design with a hull design in which fisherman can stand up in during fishing, or poling without concern for tipping over that can be molded in a unitary construction that is fast to make, durable, and inexpensive to manufacture and has a sturdy seat that can be multifunctional and removable.

Metal bass boats, wooden boats and thick hulled fiberglass boats, like Boston Whalers' are heavy, and generally require at least two people to lift the boat onto a car top due to the weight. A need exists for an 11 foot to 18 foot watercraft that can be lifted and used by one person without strain and has a removable seat.

The present embodiments provide the seat for these types of stabilized fishing watercrafts.

BRIEF DESCRIPTION OF THE DRAWINGS

The detailed description will be better understood in conjunction with the accompanying drawings as follows.

Figure 1:
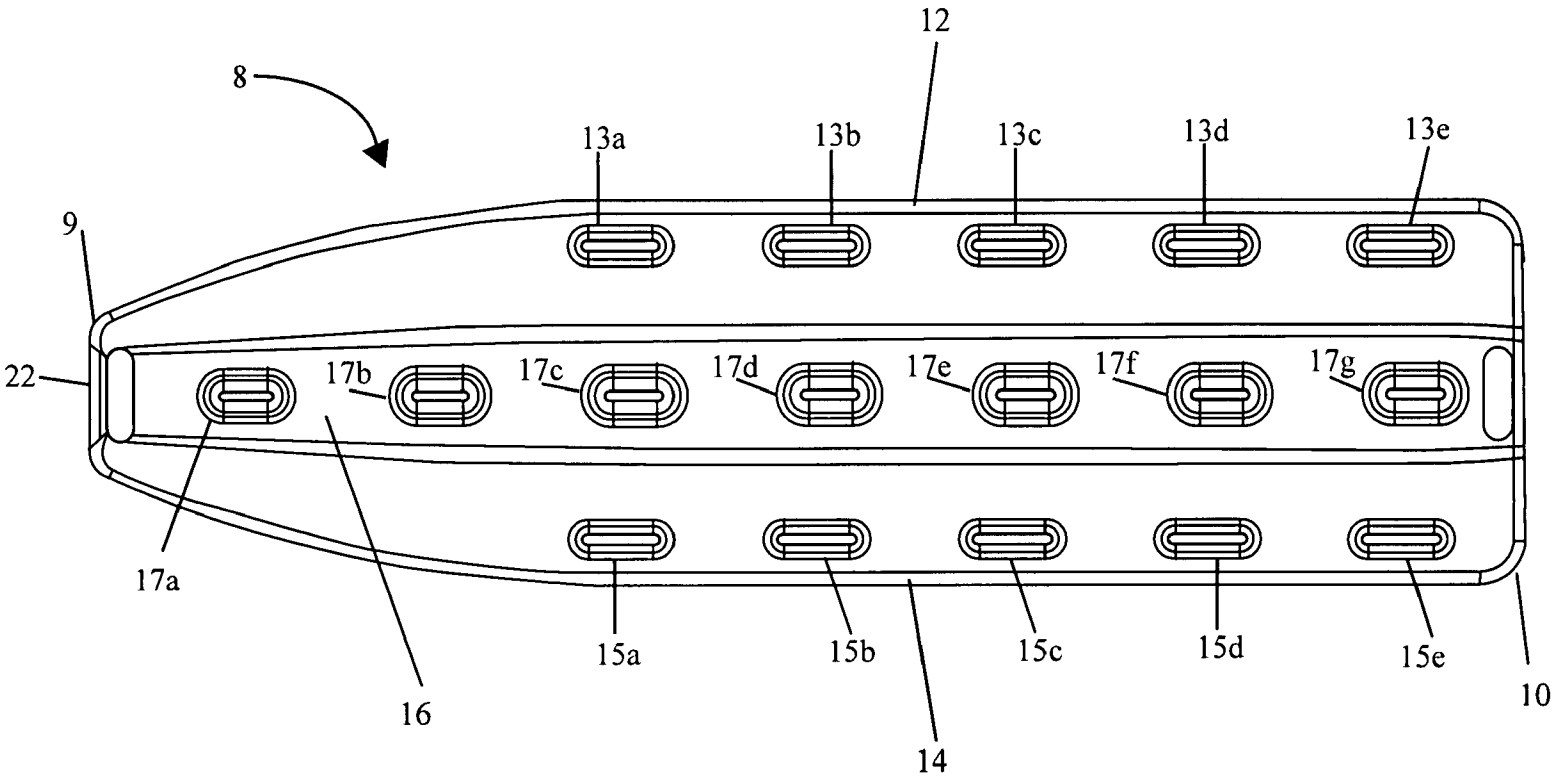
FIG. 1 depicts a bottom perspective view of an embodiment of a lightweight molded watercraft that can utilize the seat of the invention.

The present embodiments are detailed below with reference to the listed Figures.

DETAILED DESCRIPTION OF THE EMBODIMENTS

Before explaining the present embodiments of the seat invention in detail, it is to be understood that the embodiments are not limited to the particular embodiments and that the invention can be practiced or carried out in various ways.

The present embodiments relate to a molded two piece seat for sitting on or standing on, when using a lightweight watercraft. The seat can be used with watercraft that enables a person or two persons weighing up to a collective weight of 500 pounds to paddle or pole the watercraft from a standing position for fishing, for biological study of plant life or planting of endangered species or for repair of floating structures.

The molded two piece seat enables a biologist to safely protect samples taken during study, or a fisherman to hold his catch in a cool and safe container and then remove the seat without disturbing the contents for transport.

The molded two part seat is a floatation device wherein the walls of the seat can have foam filler disposed therein for insulation and floatation purposes.

The molded two piece seat is particularly usable on a watercraft described in detail in below.

The molded two piece seat has the benefit of being made from a strong, high density polymer homopolymer or copolymer for material, such as a polyamide like nylon.

The seat has a benefit in that it can hold at least three fishing poles simultaneously.

The seat has a benefit of having a pivoting lid that can also be sat upon or stood upon without deformation.

The seat is made of a material resistant to ultraviolet radiation degradation and is resistant to corrosive action from salt. The seat is also highly impact resistant and will hold it shape in the event it is dropped.

The inventive seat is made quickly, in 10% of the time of conventional wooden seats or other non-molded seats. The seat can be made at a fraction of the cost because material costs for molded seats are extremely low and only 1 person can run the molding process compared with multiple persons needed to craft custom seats in other fishing boats.

In an embodiment, the seat has four legs for engaging in grooves formed on the deck of a watercraft. Other embodiment have six legs. The grooves could be in the form of an insert placed in non-molded watercraft. The insert containing the grooves can then be secured to the deck of other types of flat watercraft, using screws or a similar device.

The exemplary watercraft to which this seat can be used is a highly stable watercraft requiring only a few inches of water to float, generally less than six inches of water, and generally not more than 3 inches of water.

The exemplary watercraft is a one piece molded watercraft having a port and a starboard hull extension connected by a bridge and a tapered graduated water channel formed between the bow and stern in the bottom of the watercraft.

The graduated channel provides for increased stability in the watercraft and allows a person(s) to stand and sit on the exemplary watercraft without tipping the watercraft or enabling the watercraft to be loaded to over 500 pound of gear without tipping over, while maintaining a draft of only a few inches. Embodiments of the exemplary watercraft can be watercraft between 10 feet to 20 feet in length. Exemplary watercrafts for use of the seat can have lengths of 10.5 feet, 14 feet, 16 feet, and 18 feet.

The exemplary watercraft has sloped edges that extend from bow to stern. A deck is formed located over and integral with the sloped edges.

In a preferred embodiment, the material of an exemplary watercraft on which the seat would operate is a watercraft made from a moldable curable polymer, or polymer composite. If a simple curable polymer is used, the polymer may be a homopolymer or a copolymer. The polymer can be polyamide but can contain optionally polypropylene, polyethylene, resins, or even some fiberglass, Inside the exemplary watercraft is inserted an expandable liquid foam to enhance buoyancy of the watercraft and to increase strength of the watercraft to prevent deformation or collapse of the watercraft from selected weights being placed on the watercraft.

In one embodiment a molded seat for individually propelled watercraft having a deck with sloped sides extending there from and a plurality of opposing grooves of a defined shape formed in the deck and sloping sides. The seat can have a multi-component raised friction fitting non-sliding removable base expending above a deck comprising a molded foam filled insulated container. The base can have at least 4 legs to integrate into corresponding grooves formed into the deck, where the base can have a bottom integral with the at least 4 legs and 4 integral side walls rising from the bottom, and where two side walls opposing each other can have small extensions to extend over the sloping sides of a watercraft for a secure engagement with the watercraft and where at least one side wall comprises at least one rod holder. The base can also have a pivoting insulated lid secured to the base container in addition to having the ability for the legs of the base container fit snugly into the opposing grooves of substantially the same shape as the legs.

In one embodiment between 1 and 4 fishing rod holders can be molded into a wall.

In an alternate embodiment the seat can have a hole molded into the seat for receiving a sliding drawer.

In yet an alternate embodiment the molded seat can have a holder molded into the base for supporting a coffee cup or a beer can.

In one embodiment the molded seat can have a magnetic latch disposed in the container of the base.

In one embodiment the molded seat can have at least one depression in the container to hold a battery inside the container and a groove for allowing the battery cable to exit the container disposed in one wall of the seat.

In an alternate embodiment the molded seat can have a drain plug to drain water from the container.

In yet another embodiment a handle can be disposed on opposing side walls for transporting the seat.

With reference to the figures, FIG. 1 depicts a bottom view of an embodiment of a watercraft. The watercraft is a one-piece molded construction.

As shown in FIG. 1, the bottom side of an embodiment of the watercraft 8 made with a one piece molded compression hull having a vessel bow 9 and a vessel stern 10 an a graduated channel 11 extending from vessel bow to vessel stern wider in the vessel bow than in the vessel stern and shallower in the vessel bow than in the vessel stern.

The graduated channel 11 is between the port hull section 12 and the starboard hull section 14.

In this bottom view, the port and starboard hull section and the graduated channel each contain 4 support columns that extend from the bottom of the hull interior to the deck. The port hull section bottom 28 sports port support columns 13*a*, 13*b*, 13*c*, 13*d*, and 13*e* while starboard hull section bottom 30 sports starboard support columns 15*a*, 15*b*, 15*c*, 15*d* and 15*e*. The vessel can have at least 4 support columns and up to 10 support columns are in each hull section and between 3 and 10 support columns are in the mid hull section.

The bottom of the hull forming the channel is the mid hull section 16 and has mid hull section support columns 17*a*, 17*b*, 17*c*, 17*d*, 17*e* and 17*f*.

Integral to the bottom of the hull and penetrating to the deck, is a bow hole 20 forming the bow handle 22 and a stern hole 24 forming the stern handle 26.

Figure 2:
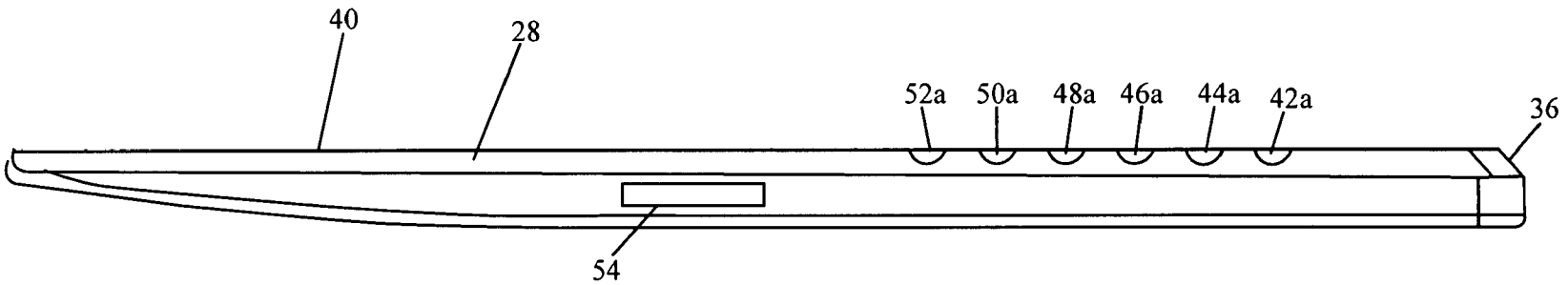
FIG. 2 depicts a side view of an embodiment of a lightweight molded watercraft that can use the seat of the invention.

The port hull section and starboard hull section each have sloped edges, the port side hull is shown in FIG. 2. The sloped edges enable waves to roll down the craft, giving the craft a quieter effect on the water, having less wave noise, making the vessel less likely to scare endangered species like manatee, and to provide fishermen with the ability to not scare fish off. The sloped edges enable the vessel to have a stealth quality, it is designed to be extremely quiet with this design.

The watercraft requires very little draft. For example, the watercraft can use only three inches of draft, thereby making the watercraft usable in the shallowest of bodies of water of just a few inches while supporting a 165 pound man and a 100 pound Labrador retriever.

Figure 3:
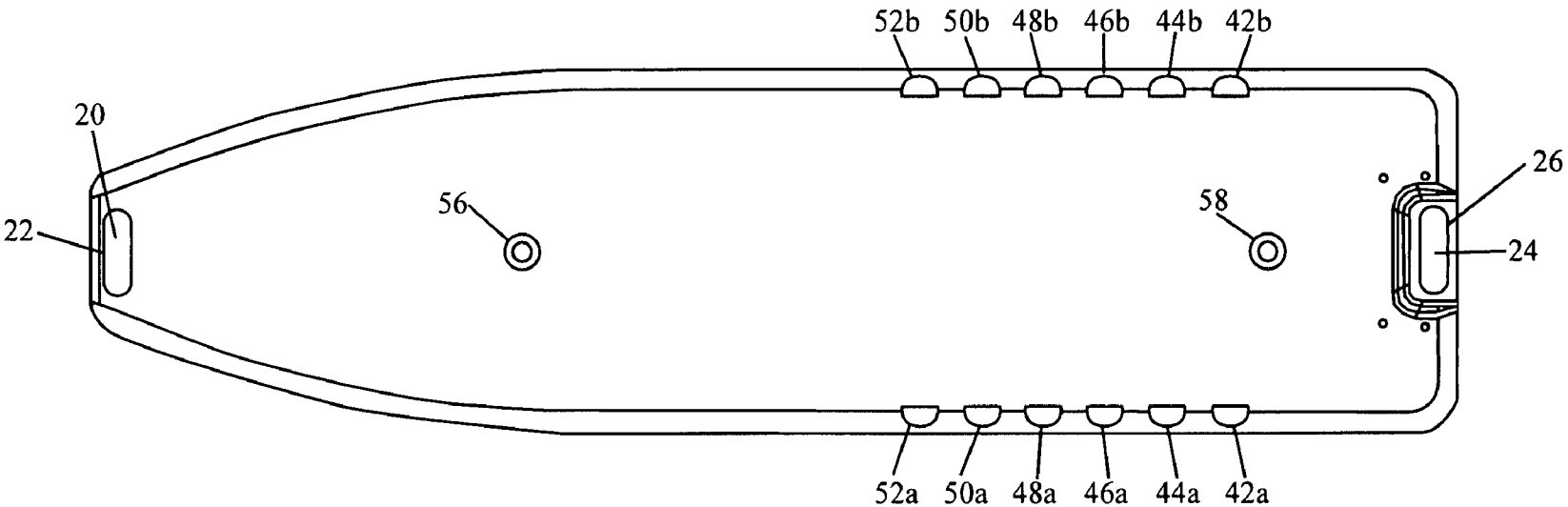
FIG. 3 depicts a top view of a lightweight molded watercraft with the grooves for the seat.

FIG. 2 depicts is a port side view of an embodiment of the watercraft also termed vessel herein. FIG. 2 depicts the port sloped edges 28. The starboard sloped edges 30 are shown in FIG. 3, the top view. FIG. 2 also shows port bow 34 and a flat bottomed port stern 36. The sloped outside edges are integral with the deck 40. The watercraft allows a person to stand on top of the watercraft, and self propel the watercraft while the watercraft remains steady.

The one piece molded watercraft is so steady so that the person on the boat can cast a fishing line without worrying about tipping the boat or falling into the water FIG. 2 also shows grooves 42*a*, 44*a*, 46*a*, 48*a*, 50*a*, and 52*a* in the port side. In the starboard side, shown in FIG. 3, the opposing matching grooves 42*b*, 44*b*, 46*b*, 48*b*, 48*b*, 50*b* and 52*b* and are shown in order from stern to bow.

The grooves are molded just into the sloping edges for supporting accessories that are placed removably on the deck, such as a seat. However, the grooves are not required on a vessel when no accessory is desired. To support the seat in a secure way, yet permit the seat to be removable, a groove in the port side has a companion groove in the starboard side. Each groove receives a leg of the seat. An adjacent groove gaain on the port side of the deck has a companion groove in the starboard side for receiving the remaining two legs of the removable seat.

In FIG. 2, the registration numbers 54 can be placed on each side of the hull. A logo can also be disposed on the hull near the registration numbers.

FIG. 3 shows a top view of the vessel 8. In this top view, the vessel bow 9 and the vessel stern 10. In this view it can be seen that the deck 40 extends over the integrated one piece molded hull. The deck, sides and hull are all a one piece molded craft.

Further the deck is formed to have at least one air release valve 56 disposed in the deck. A second air release valve 58 is also shown.

Figure 4:
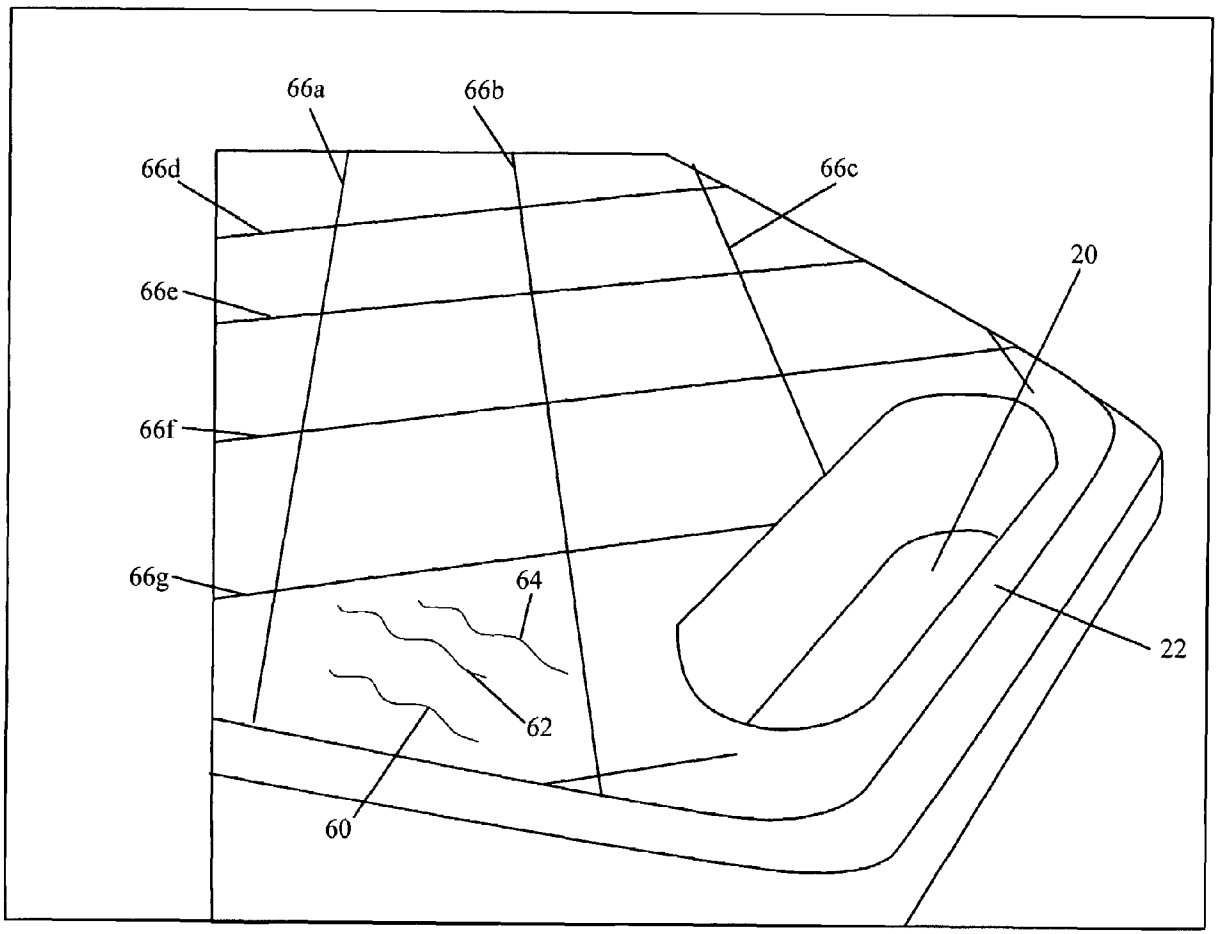
FIG. 4 depicts a bow perspective view.

FIG. 4 shows that the deck in an embodiment can be manufactured with skid reducing dimples 60, 62 and 64 creates a texture like a sidewalk which provide a non slip surface but does do not add any material to the craft.

The deck in an embodiment can also be made with shallow channels 66*a*, 66*b*, 66*c*, 66*d*, 66*e*, 66*f*, 66*g* enabling water to drain off the deck so that the water does not pool up on the deck. The channel also provides additional non-skid feature for a user.

Additional grooves can be created in the deck to provide the ability to move or reposition the seat as needed by the user.

Figure 5:
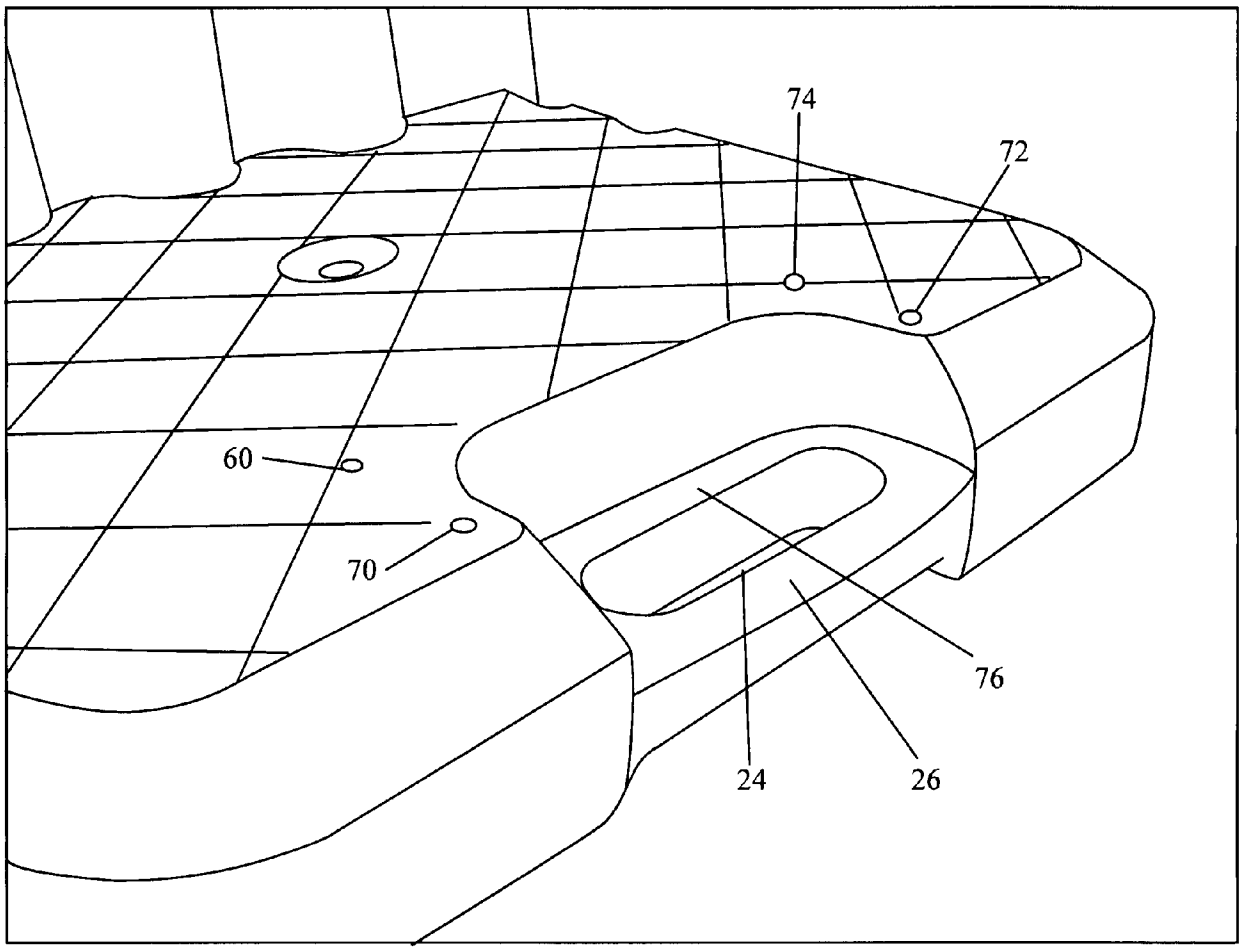
FIG. 5 is stern perspective view.

FIG. 5 shows a detail of the vessel stern 10 of the craft. Stern hole 24 creates handle 26. In this detail four motor mount inserts 68, 70, 72, 74 are shown which are threaded into the deck to provide mounting position for a trolling motor (not shown).

In an embodiment, such as the one shown in FIG. 5, a support bridge 76 opposite the stern handle can be molded into the stern to provide support to the motor mount and prevent deformation due to the weight or action from an attached trolling motor.

Figure 6:
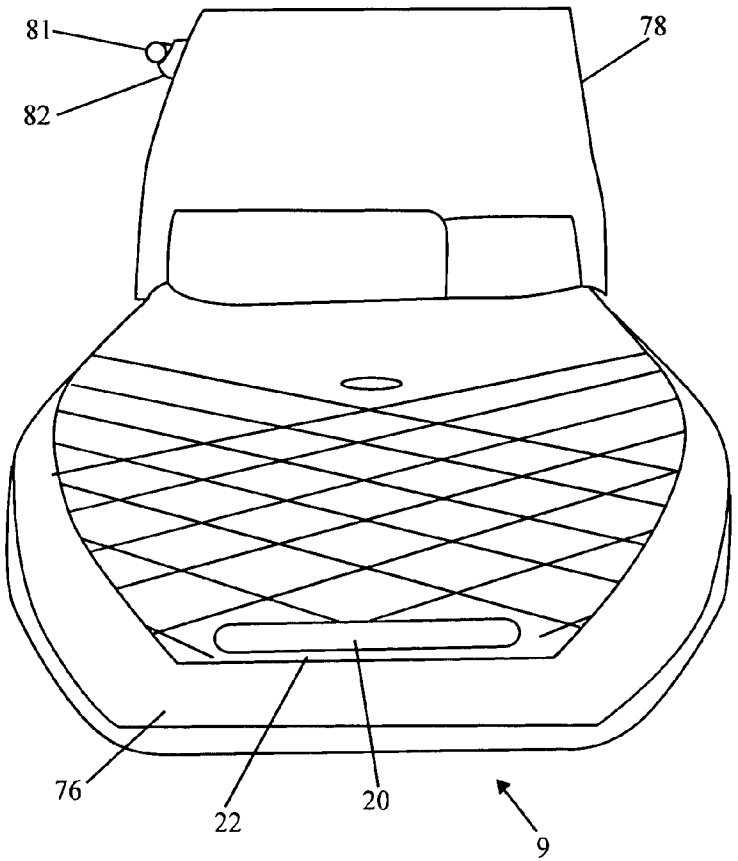
FIG. 6 is a front view of the vessel.

FIG. 6 shows a top view of the vessel bow 9. In an embodiment of the vessel the vessel bow 9 can have a bow sloped edge 76, however it is possible to have a vessel without a bow sloped edge and still be usable within the scope of the invention. The bow handle 22 is shown as well as bow hole 20 which enable a line, such as a dock line, anchor line, or tow line to be threadable through the hole and tied to the handle for towing the vessel or securing to a dock, or anchor.

A seat 78 is shown in FIG. 6 which can be an insulated container for holding items, such as food, drinks, or caught fish. The seat can be made of a plastic which is light, and hollow yet strong enough to support the weight of an individual while holding a stash of caught fish. The seat can sport an oar holder 80 for holding an oar 82 for use in propelling the vessel. The seat can be filled with a foam for buoyancy.

Figure 7:
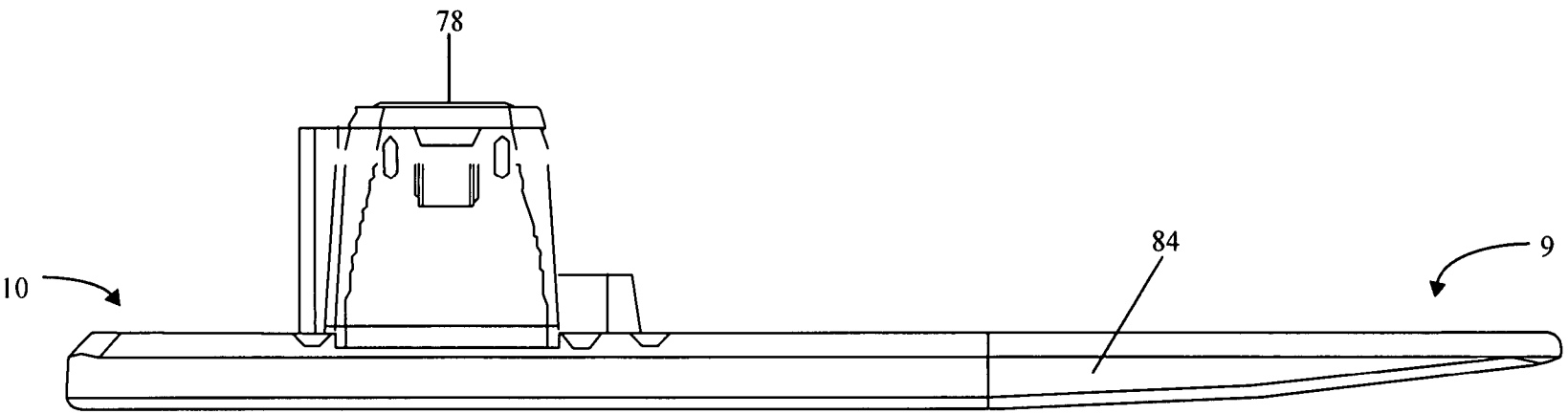
FIG. 7 is a cross sectional view of the vessel.

FIG. 7 shows a cutaway view of the vessel, containing filler 84 which can be a foam, closed cell material. The vessel is firm crafted from a molded plastic then liquid expandable foam is inserted into the craft, such as through the air release valves and then allowed to expand forming a virtually unsinkable craft.

Figure 8:
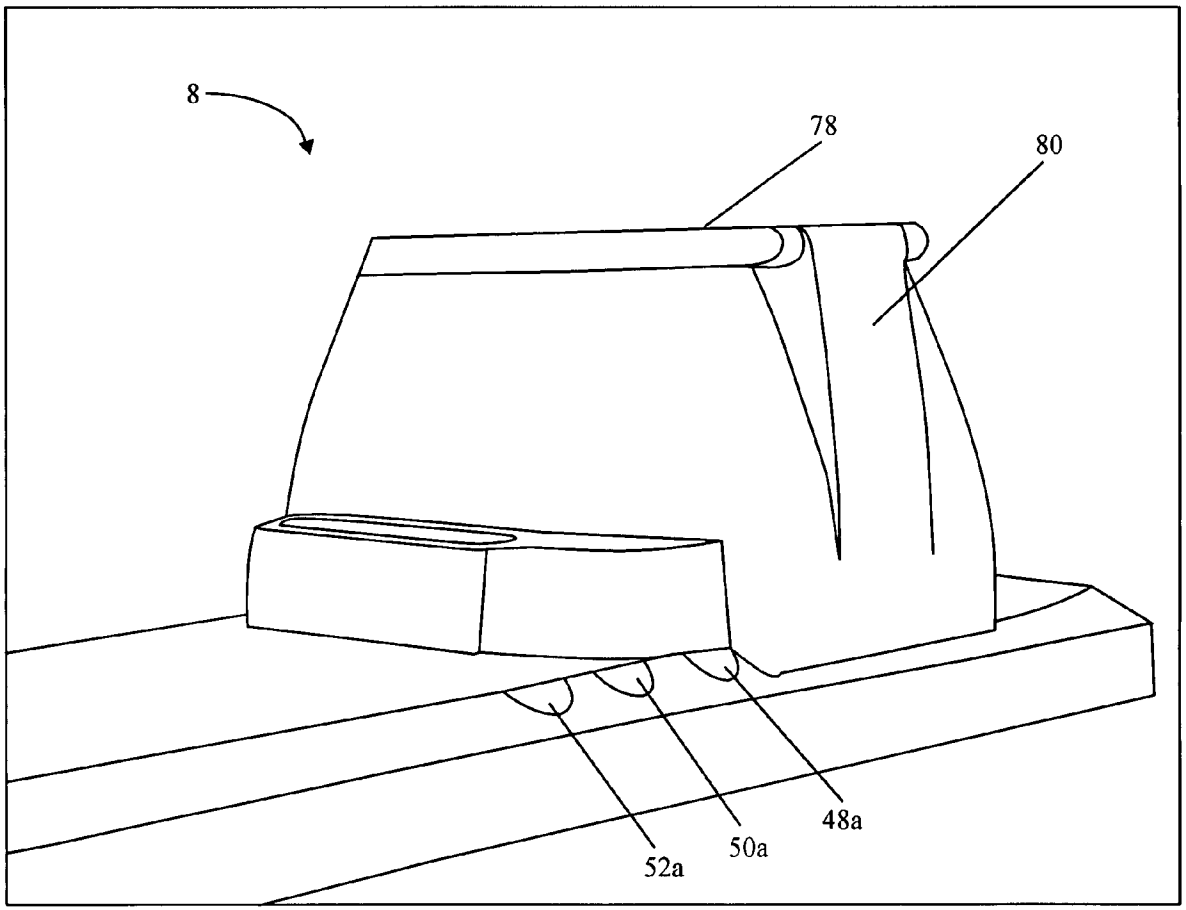
FIG. 8 a perspective view of the front of the seat.

FIG. 8 shows seat 78 that an be an insulated container for fish, food, drinks, bait, or perishable materials. The seat can also hold items that the user would prefer not to get wet, such as cell phones, lap tops, GPS or similar devices.

The seat can be made of a plastic which is light, and hollow yet strong enough to support the weight of an individual while holding a stash of caught fish.

FIG. 8 further shows the molded seat 78 detachably secured to an individually propelled watercraft having a deck with sloped sides extending there from and a plurality of grooves shown on the port side as 42*a*-52*a* and the starboard side as 42*b*-52*b*. The seat is contained in at least two pairs of opposing grooves, that is, in 4 individual grooves but preferably the seat sits in three pairs of opposing grooves, that is, in 6 individual grooves. This enables the seat's location to be moved and relocated between these grooves. FIG. 8 shows the seat located in 3 grooves in the port side of the craft, namely grooves 42*a*, 44*a*, and 46*a* because grooves 48*a*, 50*a* and 52*a* are revealed.

Complimentary opposing grooves are in the starboard side are opposite the port grooves. Both sets of grooves have a defined shape that fit the 6 legs of the seat shown in this figure. The legs are scalloped in shape in this embodiment given the circular shape of the grooves.

Figure 9:
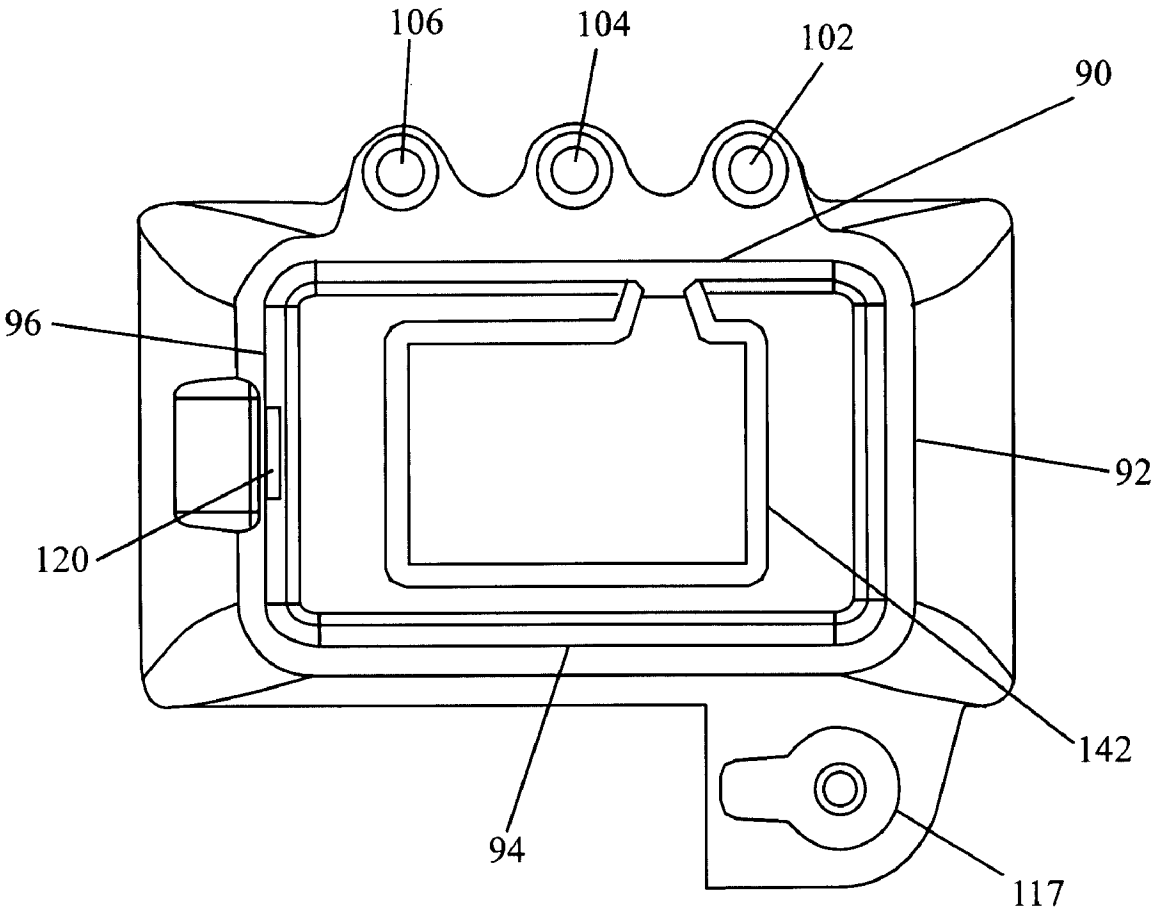
FIG. 9 a top view of the seat.
Figure 11:
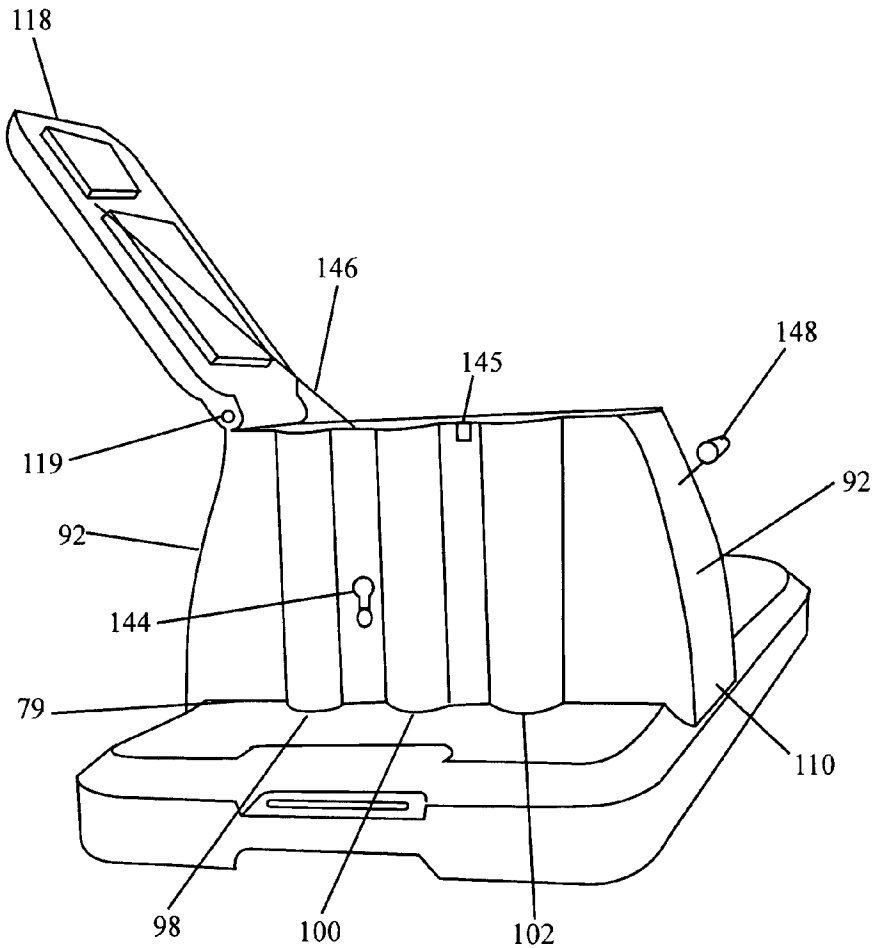
FIG. 11 is a rear view of the seat with the lid open.

The seat has a base 79 that is a bottom and 4 integral side walls rising from the bottom. FIG. 9 shows the four side walls 90, 92, 94 and 96. The side wall 90 integral with the bottom is adapted to hold at least 3 fishing rods in cylindrical forms 98, 100, 102 integral with the side wall 90. FIG. 9 also shows a depression 142 in the container to hold a battery inside the container. FIG. 11 shows a groove 145 in a side wall for allowing a battery cable connected to the battery to exit the container disposed in at least one wall of the seat.

Figure 10:
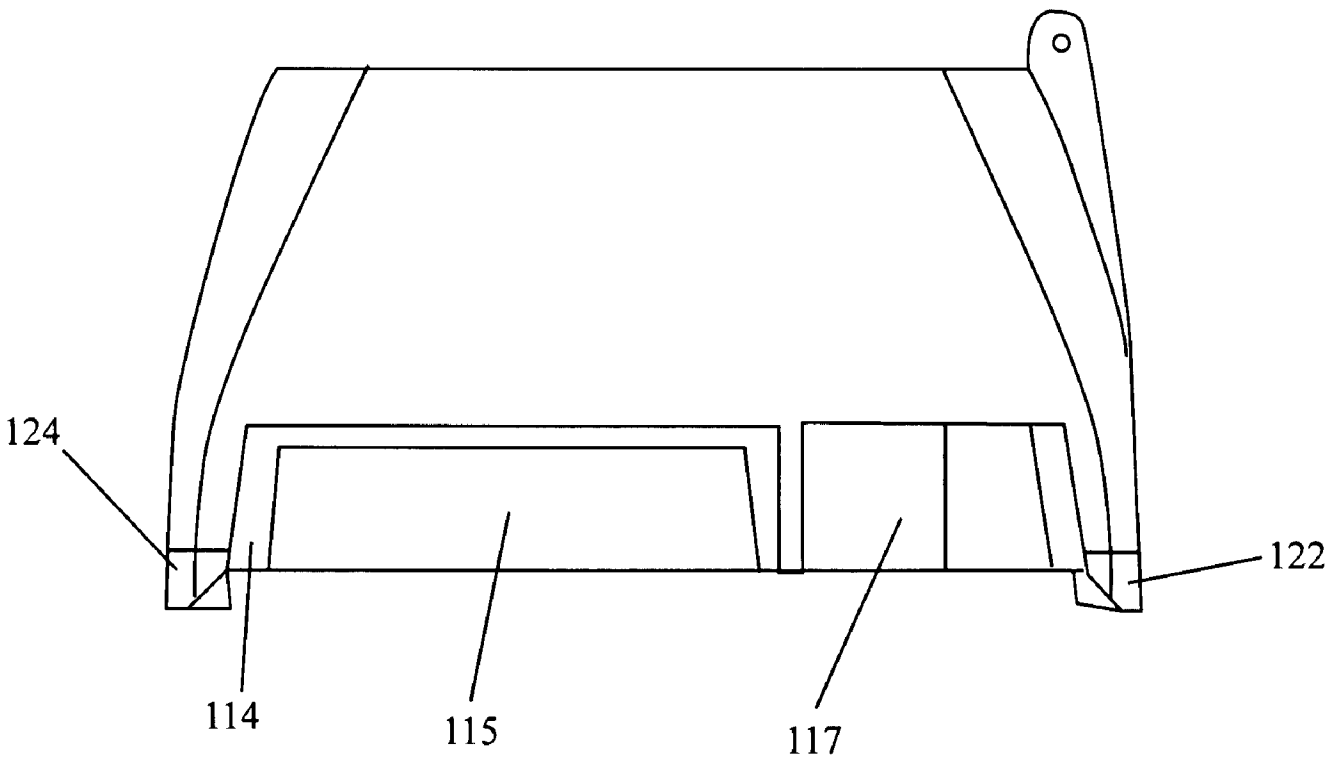
FIG. 10 is cross sectional view of the front of the seat.

FIG. 10 shows an embodiment of the seat, having a opening 114 for containing a sliding drawer 115. The sliding drawer 115 is formed of the same material as the seat, and formed in the container having a sliding engagement into the seat for holding small items. A molded holder 117 adjacent the opening can also be formed when the seat is molded as another option on the seat.

FIG. 11 also shows a pivoting insulated lid 118 that secures to the container using a metal pin 119. When the lid is closed, the insulated seat is formed. An optional magnetic latch 120 disposed on the interior of the seat, as shown in FIG. 9. Latch 120 can be used for closing the lid and preventing the lid from flying upward and off the vessel. FIG. 11 shows a drain plug 144 in side 90 for allowing water contained in the container to exist the seat when ice melts. Additionally a strap 146 can be used secured to the lid 118 and to the base 79 to keep the lid from flopping around. Optional oar holder clips 148 that looks like a cradle with a strap, can be mounted to the seat to hold an oar or flounder gig for an individual to use while using the seat and the watercraft.

The legs of the container fit snugly into the opposing grooves of the defined shape which are identical to the shape of the legs. Two opposing walls, 92 and 96 of the seat have small extensions 122 and 124, shown in FIG. 10. The small extension extend over and engage the sloped sides of a watercraft providing a secure yet removable attachment of the seat to the watercraft.

Figure 12:
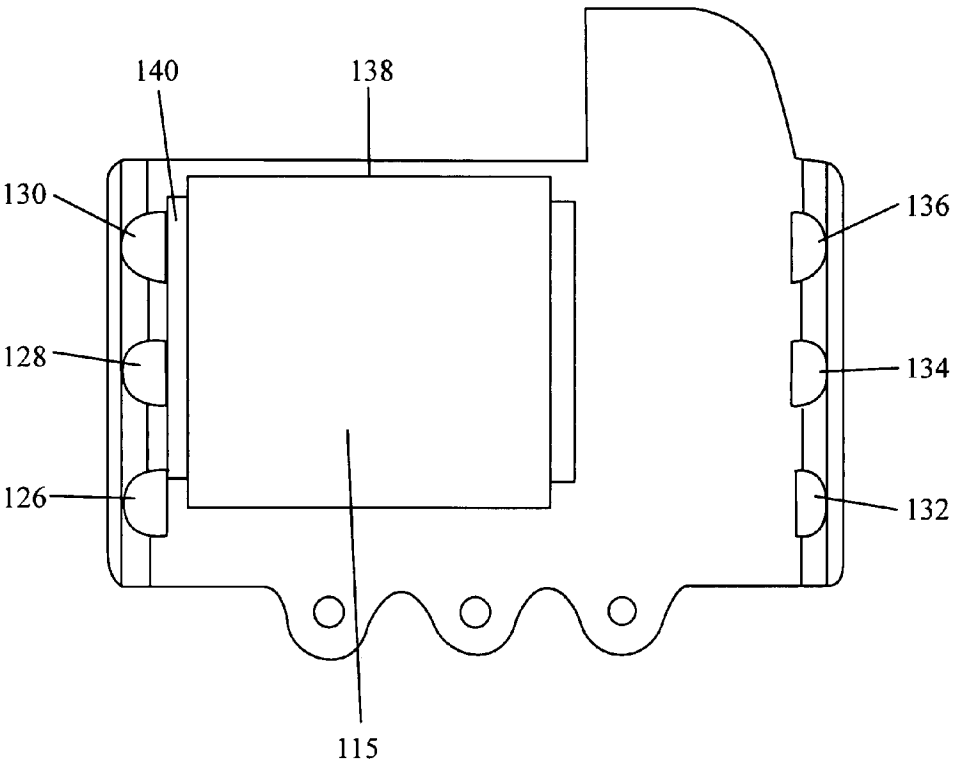
FIG. 12 is a bottom view of the seat.
Figure 13:
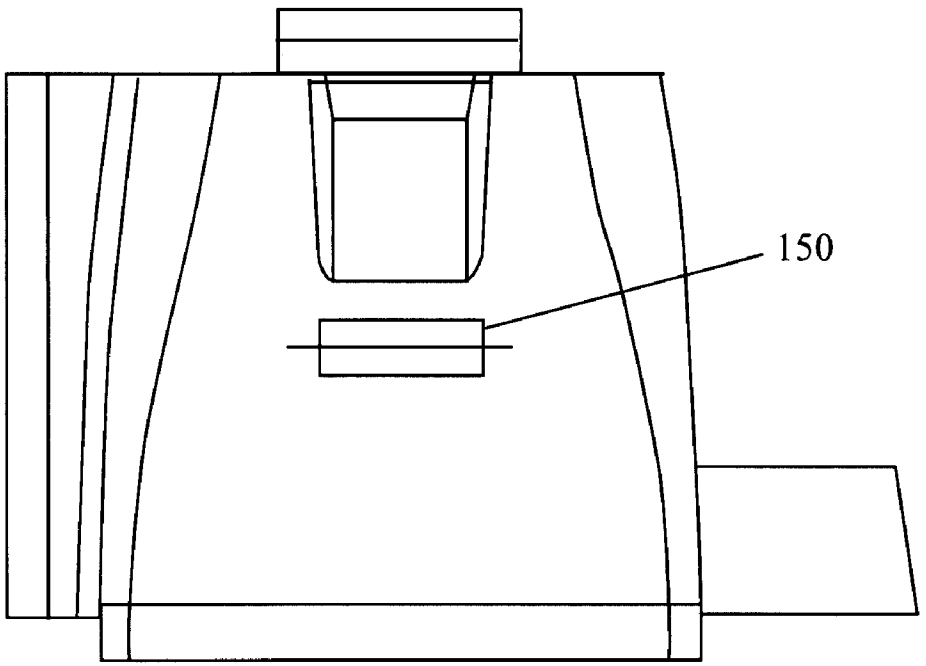
FIG. 13 is a side view of the seat.

FIG. 12 depicts a bottom view of the seat. The seat has legs 126, 128, 130, 132, 134, and 136. Each leg is shown having a scallop shape for engaging the circular grooves of the vessel's sloping sides. Each leg can be solid or hollow, be foam filled to provide buoyancy to the seat. This bottom view shows the two drawer guides 138, 140 that can be used in an embodiment of the invention for facilitating pulling in and pulling out of the sliding drawer 115.

Returning to FIG. 10 there is also depicted a handle 150 which is one of a pair of handles mounted on the outside of two opposing walls. The two handles can be used to lift the seat. The handles can be rubber handles or other strong handle.

The embodiments have been described in detail with particular reference to certain preferred embodiments, thereof, but it will be understood that variations and modifications can be effected within the scope of the embodiments, especially to those skilled in the art.

What is claimed is:

1. A molded seat for individually propelled watercraft having a deck with sloped sides extending there from and a plurality of opposing grooves of a defined shape formed in the deck and sloping sides, wherein the seat comprises:

a. a multi-component raised friction fitting non-sliding removable base extending above a deck comprising a molded foam filled insulated container having at least 4 legs to integrate into corresponding grooves formed into the deck, wherein the base has a bottom integral with the at least 4 legs and 4 integral side walls rising from the bottom, and wherein two side walls opposing each other further comprise small extensions to extend over the sloping sides of a watercraft for a secure engagement with the watercraft and wherein at least one side wall comprises at least one rod holder;

b. a pivoting insulated lid secured to the base container; and wherein the legs of the base container fit snugly into the opposing grooves of substantially the same shape as the legs.

2. The molded seat of claim 1, wherein from 1 to 4 fishing rod holders are molded into a wall.

3. The molded seat of claim 1, wherein the seat further comprises a hole molded into the seat for receiving a sliding drawer.

4. The molded seat of claim 1, further comprising a holder molded into the base for supporting a coffee cup or a beer can.

5. The molded seat of claim 1, further comprising a magnetic latch disposed in the container of the base.

6. The molded seat of claim 1, at least one depression in the container to hold a battery inside the container and a groove for allowing a battery cable to exit the container disposed in at least one wall of the seat.

7. The molded seat of claim 1, further comprising a drain plug to drain water from the container.

8. The molded seat of claim 1 further comprising a handle disposed on opposing side walls for transporting the seat.

* * * * *